US011774208B1

(12) United States Patent
Bailey

(10) Patent No.: US 11,774,208 B1
(45) Date of Patent: Oct. 3, 2023

(54) CONVERTIBLE SHOOTING ASSEMBLY FOR FIREARMS

(71) Applicant: Kudzu Arms, LLC, Hogansville, GA (US)

(72) Inventor: Christopher G. Bailey, Hogansville, GA (US)

(73) Assignee: KUDZU ARMS, LLC, Hogansville, GA (US)

( * ) Notice: Subject to any disclaimer, the term of this patent is extended or adjusted under 35 U.S.C. 154(b) by 0 days.

(21) Appl. No.: 17/713,932

(22) Filed: Apr. 5, 2022

(51) Int. Cl.
*F41A 23/14* (2006.01)
*A45B 3/14* (2006.01)

(52) U.S. Cl.
CPC ..... *F41A 23/14* (2013.01); *A45B 3/14* (2013.01)

(58) Field of Classification Search
CPC ..... F41A 23/04–14; A45B 3/14
USPC ..... 42/94
See application file for complete search history.

(56) References Cited

U.S. PATENT DOCUMENTS

| | | | | |
|---|---|---|---|---|
| 3,445,082 | A * | 5/1969 | Frazer | F41A 23/08 248/183.3 |
| 5,930,931 | A * | 8/1999 | Watson | F41A 23/04 206/317 |
| 8,607,491 | B2 * | 12/2013 | Moody | F41A 23/08 42/72 |
| 2008/0011344 | A1 * | 1/2008 | Barker | G03B 17/561 135/66 |
| 2010/0269393 | A1 * | 10/2010 | Bean | F41A 23/06 42/94 |
| 2014/0215888 | A1 * | 8/2014 | Barber | F41A 23/14 42/94 |
| 2018/0125061 | A1 * | 5/2018 | Komater | F16M 11/28 |
| 2018/0180373 | A1 * | 6/2018 | Scott | F41A 23/06 |
| 2020/0103196 | A1 * | 4/2020 | Keller | F16M 11/041 |

* cited by examiner

*Primary Examiner* — Bret Hayes
(74) *Attorney, Agent, or Firm* — EVERSHEDS SUTHERLAND (US) LLP

(57) ABSTRACT

Shooting assemblies having a shooting rest, a sheath, and a firearm rest. The shooting assemblies alternate between a stowed and a deployed configuration for use as a walking staff in the stowed configuration, and as a shooting rest in the deployed configuration. The height and/or position of the shooting rest and firearm rest is adjustable to accommodate different users and different terrains on which the shooting assemblies are used.

14 Claims, 3 Drawing Sheets

CONVERTIBLE SHOOTING ASSEMBLY FOR FIREARMS

FIELD

The disclosure generally relates to firearms and, in particular, stable shooting platforms for firearms.

BACKGROUND

While hunting, it may be necessary to have a stable shooting platform at any given time. Natural rests, such as trees, stumps, or rocks, may be used, but these natural rests may not always be available. Portable shooting rests also exist, but these shooting rests may not provide the necessary level of stability. For example, monopods may hold the front of a firearm at a fixed height, but only offer stability about this one axis. Cross sticks are also common, but only function to stabilize a firearm about two axis. These shooting rests may also be cumbersome to transport, especially while on foot.

SUMMARY

The disclosure generally relates to firearms and, in particular, stable shooting platforms. In aspects, a shooting assembly is provided, which includes a shooting rest, a sheath, and a firearm rest attached to the sheath. The shooting rest includes a proximal portion and a distal portion. The sheath is disposed about the proximal portion of the shooting rest. The distal portion of the shooting rest includes three legs. The sheath may move between a first position and a second position, such that the shooting assembly may alternate between a stowed configuration when the sheath is in the first position and a deployed configuration when the sheath is in the second position.

In other aspects, a shooting assembly is provided, which includes a shooting rest, a sheath, and a firearm rest attached to the sheath. The shooting rest includes a proximal portion and a distal portion. The sheath is disposed about and may move along the vertical axis of the proximal portion of the shooting rest. The firearm rest may be attached to the sheath at different positions.

In further aspects, a shooting assembly is provided, which includes a shooting rest, a sheath, and a firearm rest attached to the sheath. The shooting rest includes a proximal portion and a distal portion. The sheath is disposed about the proximal portion of the shooting rest. The shooting rest may alternate between a stowed configuration and a deployed configuration.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout the disclosure, depending on the context, singular and plural terminology may be used interchangeably.

DETAILED DESCRIPTION

Figure 1C:
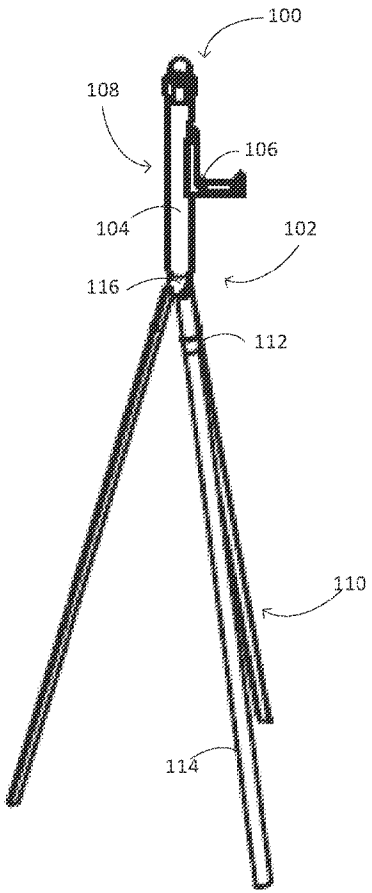
FIG. 1C depicts a side view of a shooting assembly in a shooting configuration, in accordance with one or more embodiments of the disclosure.

The disclosure generally relates to firearms and, in particular, stable shooting platforms. The present disclosure describes a shooting assembly capable of stabilizing a firearm about three axes. In aspects, the shooting assembly may be used as a walking staff to aid hunters while navigating rough terrain. In other aspects, the shooting assembly may be used as a shooting rest to stabilize a firearm. The dual function of the shooting assembly disclosed herein is particularly advantageous because users will not be required to carry additional equipment, which can often be burdensome. Moreover, the adjustability of the shooting assembly allows users to use the shooting assembly on a variety of terrains with relative ease.

In aspects, the shooting assembly includes a shooting rest, a sheath, and a firearm rest attached to the sheath. The sheath may be disposed about the proximal portion of the shooting rest. The distal portion of the shooting rest has three legs. The sheath may slide about the proximal portion of the shooting rest, moving between a first position and a second position. When the sheath is in the first position, the legs remain together such that the shooting rest is in a walking configuration. When the sheath is in the second position, the legs are free to separate such that the shooting rest may be put into a shooting configuration.

FIGS. 1A-3C depict a shooting assembly 100. The shooting assembly 100 includes a shooting rest 102, a sheath 104, and a firearm rest 106. The firearm rest 106 is adjustably secured to the sheath 102, such that the position of the firearm rest 106 may be adjusted (e.g., vertically up and down) as necessary. In some instances, the firearm rest 106 may be L-shaped. The shooting rest 102 has a proximal portion 108 (e.g., a top portion) and a distal portion 110 (e.g., a bottom portion), separated by a hinge 116 (shown in FIGS. 1B-1C). In some instances, the sheath 104 is disposed about the proximal portion 108 of the shooting rest 102, and may be slid between the proximal portion 108 and the distal portion 110 over the hinge 116 to contact a ledge 112 disposed on the distal portion 110 when the sheath 104 is in a lowered position (shown in FIG. 1A). The distal portion 110 of the shooting rest 102 may have at least one leg 114. In some instances, the distal portion 110 of the shooting rest 102 has three legs 114. In other instances, the distal portion 110 of the shooting rest 114 has more than three legs.

The shooting assembly 100 is configured to move from a stowed configuration (e.g., compact configuration) to a deployed configuration. In the stowed configuration, the shooting assembly 100 may be used as a walking staff. For example, a user may grasp the sheath 104 about the firearm rest 106. In the deployed configuration, the shooting assembly 100 may be used as a stable shooting surface. For example, a user may rest a firearm on the firearm rest 106.

Figure 1B:
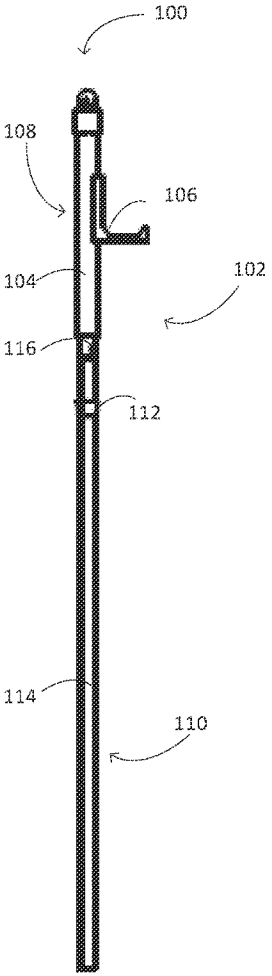
FIG. 1B depicts a side view of a shooting assembly in a transitional configuration, in accordance with one or more embodiments of the disclosure.
Figure 1A:
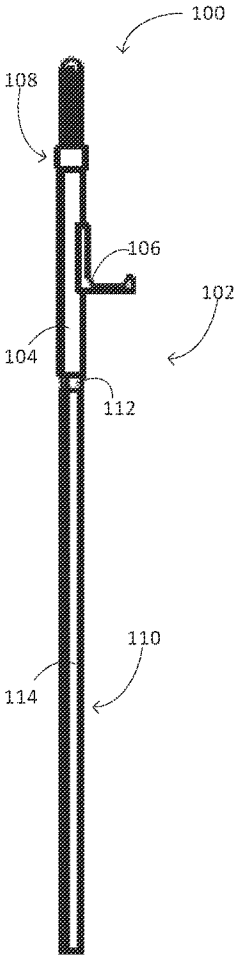
FIG. 1A depicts a side view of a shooting assembly in a walking configuration, in accordance with one or more embodiments of the disclosure.

FIG. 1A depicts the shooting assembly 100 in the stowed configuration. To maintain the shooting assembly 100 in the stowed configuration, the sheath 104 is lowered to maintain the legs 114 in a closed position. When the sheath 104 is lowered over the hinge 116, the tops of the legs 114 are retained within the sheath 104. The ledge 112 is disposed about the legs 114 (e.g., the tops of the legs), and the ledge 112 is formed collective by the legs 114 being in the stowed position. The sheath 104 will contact the ledge 112, which prevents the sheath 104 from traversing the entire length of the legs 114. In this stowed configuration, the legs 114 remain together. It would be understood that, because the legs 114 are only partially enclosed in the sheath 104, some space between the legs 114 may be possible. However, the legs 114 do essentially remain together while the shooting assembly 100 is in the stowed configuration.

In some embodiments, the shooting assembly 100 may include additional components to prevent separation of the legs 114. For example, the shooting assembly 100 may include a strap configured to wrap around the legs 114. The strap could be placed at any point along the legs. Alternatively, the shooting assembly 100 may include a sleeve sized to fit around and secure the bottom portion of the legs.

FIG. 1B depicts the shooting assembly 100 as it is being transitioned from the stowed configuration to the deployed configuration. To transition the shooting assembly 100 from the stowed to the deployed configuration, the sheath 104 is raised above the hinge 116 so that it no longer contacts the ledge 112. Raising the sheath 104 exposes the hinge 116, thereby allowing movement of the legs 114 into a deployed position.

In aspects, the hinge 116 is spring loaded so that the legs 114 spontaneously deploy when the sheath 104 is raised above the hinge 116. The legs 114 may be deployed to contact the ground at a standard, predetermined angle with the ground. For example, the legs 114 may be deployed to contact the ground at a 45 degree angle. In other aspects, the hinge 116 allows for manual deployment of the legs 114. For example, when the sheath 104 is raised above the hinge 116, a user may then be capable of moving and positioning the legs 114 at a desired angle with the ground.

In aspects, the legs 114 are independently adjustable. For example, to accommodate an incline, the legs 114 may each contact the ground at different angles to maintain the shooting assembly 100 in an upright position. In aspects where the hinge 116 is spring loaded, the legs 114 may be adjusted after being deployed at the standard deployment angle. In other aspects where the hinge 116 is configured for manual deployment, the legs 114 may be adjusted in a manner similar to the initial deployment of the legs 114. In some instances, the legs 114 may be telescoping. That is, the legs may be extended or shorted as needed.

FIG. 1C depicts the shooting assembly 100 in the deployed configuration. When the shooting assembly 100 is in the deployed configuration, the legs 114 form a stable shooting base. In aspects where the shooting rest 102 has three legs 114, the legs 114 form a tripod when the shooting assembly 100 is in the deployed configuration. The shooting assembly 100 therefore may be stable on almost any plane or incline on which it is placed. In some embodiments, the legs 114 may be secured in place with pins. In other embodiments, the legs 114 may be under tension (e.g., spring loaded) so that the legs 114 remain in place without an additional securing mechanism.

In the deployed configuration, the shooting assembly 100 is height adjustable. For example, a user may be standing on an elevated surface, in which case the height of the shooting assembly 100 must be raised. To increase the height of the shooting assembly 100, the legs 114 are brought closer together. Alternatively, the user may be kneeling, sitting, or laying on the ground, in which case the height of the shooting assembly 100 must be lowered. To decrease the height of the shooting assembly, the legs 114 are spread further apart. In other instances, the legs 114 may be telescoping such that the length of each leg may be adjusted accordingly.

In certain embodiments, the height of the shooting assembly 100 may be inversely proportional to the distance between each of the legs 114 and/or the adjustment in the length of the legs if they are telescoping. However, it would be understood that in some cases, the distance between the legs 114 may be increased while the height of the shooting assembly 100 is unchanged. For example, the distance between one or more legs 114 may be increase to account for an incline, but the height of the shooting assembly 100 remains substantially unchanged.

Figure 2B:
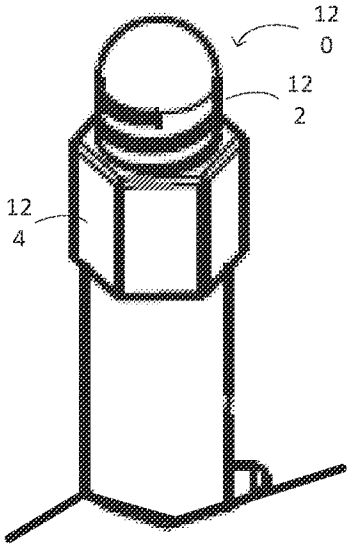
FIG. 2B depicts an exploded view of a locking system, in accordance with one or more embodiments of the disclosure.
Figure 2A:
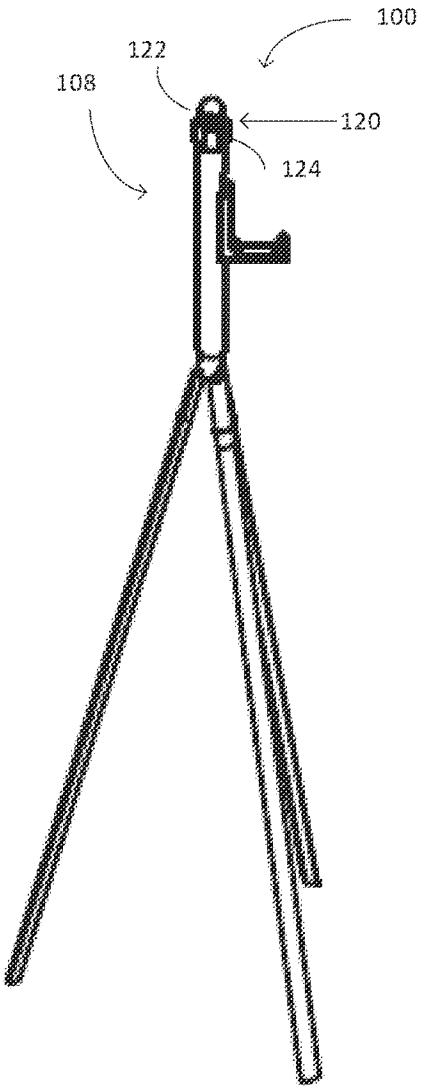
FIG. 2A depicts a side view of the shooting assembly with a locking system, in accordance with one or more embodiments of the disclosure.

To retain the shooting assembly 100 in the deployed configuration, the sheath 108 is fixed at the top of the proximal portion 104 of the shooting rest 102 with a locking system 120. FIG. 2A depicts the shooting assembly 100, with the locking system 120, in the deployed configuration. FIG. 2B depicts the locking system 120 in greater detail. In aspects, the locking system 120 includes a threaded portion 122 and a ring 124. In some aspects, the proximal portion 108 itself is the threaded portion 122. In other embodiments, the threaded portion 122 may be fixedly attached to the proximal portion 108 of the shooting rest 102.

The ring 124 is threaded to mate with the threaded portion 122. The ring 124 is attached to the sheath 104, but may rotates independently of the sheath 104. For example, the ring 124 may rotate while the sheath 104 remains still. The ring 124 may be configured to rotate in two direction. When the ring 124 rotates in a first direction, the connection between the ring 124 and the threaded portion 122 is loosened. While the connection between the ring 124 and the threaded portion 122 is loosened, the sheath 104 is free to move vertically about the proximal portion 108 of the shooting rest 102. When the sheath 104 is properly positioned on the proximal portion 108, either in the raised or lowered position, the ring 124 rotates in a second direction to tighten the connection between the ring 124 and the threaded portion 122.

In other aspects, the locking system 120 is a quick-release cam lock. To secure the sheath 104 about the proximal portion 108 of the shooting rest 102, either in the raised or lowered position, the cam lock is closed to secure the sheath 104 to the proximal portion 104. To move the sheath 104, the cam lock is released and may again be closed to re-secure the sheath 104 to the proximal portion 108 of the shooting rest.

When the shooting assembly 100 is in the deployed configuration, the shooting assembly 100 provides a portable and adjustable stable shooting surface. For example, when a user has reached their desired vantage point, they may deploy the shooting assembly 100 and adjust the height as necessary. In use, the user may place the barrel (or another part) of their firearm on the firearm rest 106 so that the barrel is stable while the user is shooting. If necessary, the user may also adjust the height of the firearm rest 106 to better fit their height or preferred shooting stance.

Referring now to FIGS. 3A-3D, the firearm rest 106 is depicted. The firearm rest 106 has an attachment portion 126 and a rest portion 128. The rest portion 128 may extend perpendicularly from the attachment portion 126 to support a barrel of a firearm. The rest portion 128 may also have a lip 130 to retain a barrel of a firearm on the rest portion 128. For example, the firearm rest 106 may be L-shaped.

Figure 3A:
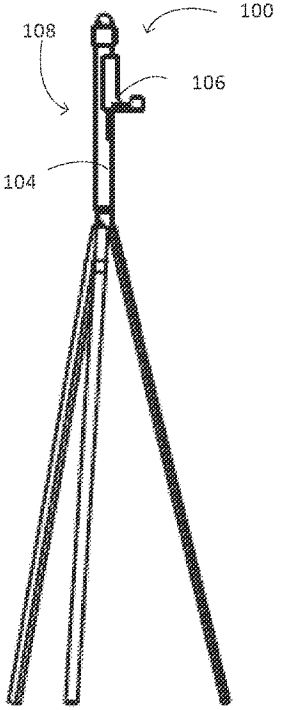
FIG. 3A depicts a front view of a shooting assembly with a firearm rest in a raised position, in accordance with one or more embodiments of the disclosure.
Figure 3B:
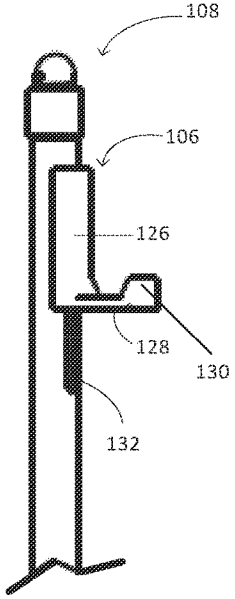
FIG. 3B depicts an exploded view a firearm rest in a raised position, in accordance with one or more embodiments of the disclosure.
Figure 3C:
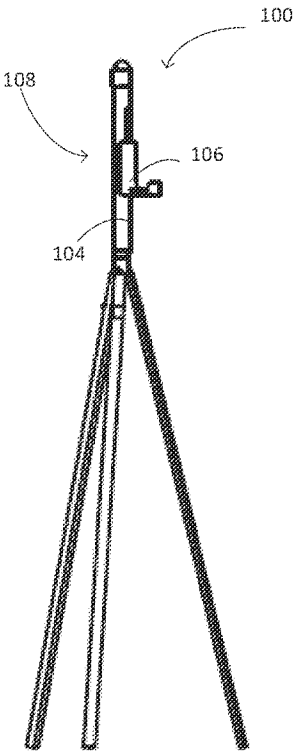
FIG. 3C depicts a front view of a shooting assembly with a firearm rest in a lowered position, in accordance with one or more embodiments of the disclosure.
Figure 3D:
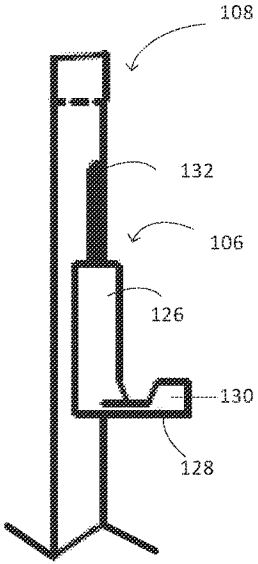
FIG. 3D depicts an exploded view of a firearm rest in a lowered position, in accordance with one or more embodiments of the disclosure.

FIG. 3A depicts the shooting assembly 100, with the firearm rest 106 attached to the sheath 104 in the highest position. FIG. 3B depicts the sheath 104, with the firearm rest 106 attached in the highest position. FIG. 3C depicts the shooting assembly 100, with the firearm rest 106 attached to the sheath 104 in the lowest position. FIG. 3D depicts the sheath 104, with the firearm rest 106 attached in the lowest position.

The attachment portion 126 is secured to a receiving slot 132 on the sheath 108. In embodiments, the slot 132 may have a plurality of holes configured to receive a screw. The attachment portion 126 may also have a hole configured to receive a screw. The screw may be disposed through the hole of the attachment portion 126 and one of the plurality of holes in the slot 132 to secure the firearm rest 106 to the sheath 104. Use of a screw to secure the firearm rest 106 to the sheath 104 may provide for a more permanent attachment. For example, it may be preferable for a user to secure the firearm rest 106 to the sheath 104 with a screw if the user will always use the shooting assembly 100 with the firearm rest 106 at the same height.

In other embodiments, the slot 132 may have a plurality of holes configured to receive a pin. The attachment portion 126 may also have a hole configured to receive a pin. The pin may be disposed through the hole of the attachment portion 126 and one of the plurality of holes in the slot 132 to secure the firearm rest 106 to the sheath 104. Use of a pin to secure the firearm rest 106 to the sheath 104 may provide for a more temporary attachment. For example, a pin may be preferable where a user will be using the shooting assembly 100 with the firearm rest 106 at different heights, or where multiple users may use one shooting assembly.

In further embodiments, the slot 132 may have a plurality of ledges configured to mate with a latching mechanism of the firearm rest 106. For example, the attachment portion 126 may have a hooked latch configured to mate with the ledges of the slot 132. In even further embodiments, the attachment portion 126 may be fitted with a quick release cam lock, similar to that described with respect to the sheath 104. Both the latches and cam lock provide for temporary attachments, similar to that described with respect to the pin.

Advantageously, the firearm rest 106 may be attached to slot 132 at various heights. For example, the firearm rest 106 may be attached to the top of the slot, as shown in FIGS. 3A-3B, to accommodate a tall user. Alternatively, the firearm rest 106 may be attached to the bottom of the slot, as shown in FIGS. 3C-3D, to accommodate a short user. It would also be understood that the firearm rest 106 may be attached to the slot 132 at points intermediate to the bottom and the top of the slot. Accordingly, the flexible placement of the firearm rest 106 may accommodate a variety of users with different heights and/or shooting preferences.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

Conditional language, such as, among others, "can," "could," "might," or "may," unless specifically stated otherwise, or otherwise understood within the context as used, is generally intended to convey that certain embodiments could include, while other embodiments may not include, certain features, elements, or steps. Thus, such conditional language is not generally intended to imply that features, elements, or steps are in any way required for one or more embodiments.

That which is claimed is:

1. A shooting assembly comprising:

a shooting rest defining a proximal portion and a distal portion;

a sheath disposed about the shooting rest, wherein the sheath is configured to alternate between a first position and a second position; and a firearm rest secured to the sheath, wherein the distal portion of the shooting rest comprises three legs, and wherein the shooting assembly is configured to alternate between a stowed configuration when the sheath is in the first position and a deployed configuration when the sheath is in the second position.

2. The shooting assembly of claim 1, wherein the proximal portion of the shooting rest comprises a locking system, wherein the locking system is configured to retain the sheath in the second position.

3. The shooting assembly of claim 2, wherein the locking system comprises a threaded portion of the proximal portion of the shooting rest and a ring, wherein the ring is secured about the sheath and wherein the ring is configured to mate with the threaded portion.

4. The shooting assembly of claim 1, wherein the sheath comprises a slot configured to mate with the firearm rest.

5. The shooting assembly of claim 4, wherein firearm rest is configured to be secured to the sheath at different heights.

6. The shooting assembly of claim 1, further comprising a ledge and a hinge, wherein the shooting rest is configured to contact the ledge when the sheath is in the first position, and wherein the hinge is exposed when the sheath is in the second position.

7. The shooting assembly of claim 6, wherein the hinge enables the shooting rest to alternate between the stowed configuration and the deployed configuration.

8. The shooting assembly of claim 1, wherein each of the three legs are configured to be adjusted independently.

9. The shooting assembly of claim 1, wherein a distance between each of the three legs is inversely proportional to a height of the shooting rest.

10. A shooting assembly comprising:

a shooting rest defining a proximal portion and a distal portion, wherein the distal portion of the shooting rest comprises three legs;

a sheath disposed about the shooting rest; and a firearm rest secured to the sheath;

wherein the sheath is configured to move about the proximal portion of the shooting rest, alternating between a lowered position for maintaining the shooting assembly in a stowed configuration where the three legs remain together and a raised position for maintaining the shooting rest in a deployed configuration where the three legs are configured as a tripod, and wherein the firearm rest is configured to be attached to the sheath at different heights.

11. The shooting assembly of claim 10, wherein a distance between each of the three legs is inversely proportional to a height of the shooting rest.

12. The shooting assembly of claim 10, wherein the sheath comprises a slot configured to mate with the firearm rest at different positions.

13. A shooting assembly comprising:

a shooting rest defining a proximal portion and a distal portion comprising three legs;

a sheath disposed the shooting rest; and a firearm rest secured to the sheath;

wherein the shooting assembly is configured to alternate between a stowed configuration and a deployed configuration, wherein the sheath is configured to maintain the three legs together when the shooting assembly is in the stowed configuration, and wherein the three legs are configured as a tripod in the deployed configuration when the sheath is raised.

14. The shooting assembly of claim 13, wherein the firearm rest may be secured to the sheath in different positions to accommodate users of different heights.

* * * * *